US007666562B2

(12) United States Patent
Carter, Jr. et al.

(10) Patent No.: US 7,666,562 B2
(45) Date of Patent: Feb. 23, 2010

(54) IMAGE FORMING MEDIA CONTAINING REFLECTING PIGMENT

(75) Inventors: Albert Munn Carter, Jr., Richmond, KY (US); Thomas George Twardeck, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 139 days.

(21) Appl. No.: 11/362,383

(22) Filed: Feb. 23, 2006

(65) Prior Publication Data

US 2007/0196753 A1 Aug. 23, 2007

(51) Int. Cl.
*G03G 9/00* (2006.01)

(52) U.S. Cl. ..... 430/106.1; 430/106.2

(58) Field of Classification Search ..... 430/106.1, 430/106.2

See application file for complete search history.

(56) References Cited

U.S. PATENT DOCUMENTS

| | | | | |
|---|---|---|---|---|
| 4,424,292 | A | 1/1984 | Ravinovitch et al. | 524/88 |
| 6,531,254 | B1 | 3/2003 | Bedells et al. | 430/109.3 |
| 6,531,256 | B1 | 3/2003 | Bedells et al. | 430/137.14 |
| 6,559,590 | B1 | 5/2003 | Mori et al. | 313/466 |
| 6,628,398 | B1 | 9/2003 | Denton et al. | 356/445 |
| 6,677,093 | B2 * | 1/2004 | Yoshino et al. | 430/106.2 |
| 2003/0073016 | A1 * | 4/2003 | Hayashi et al. | 430/106.2 |
| 2003/0190541 | A1 * | 10/2003 | Jadwin et al. | 430/106.1 |
| 2005/0026060 | A1 * | 2/2005 | Ogawa et al. | 430/106.1 |
| 2005/0126441 | A1 * | 6/2005 | Skelhorn | 106/409 |
| 2005/0215685 | A1 * | 9/2005 | Haines | 524/430 |
| 2006/0003244 | A1 * | 1/2006 | Grande et al. | 430/106.2 |
| 2006/0035162 | A1 * | 2/2006 | Sugimoto et al. | 430/106.1 |
| 2007/0072102 | A1 * | 3/2007 | Dojo et al. | 430/106.1 |

OTHER PUBLICATIONS

Ferro Performance Pigments and Colors; Geode Complex Inorganic Color Pigments; Product Information "10202 Eclipse™ Black: Chromium Free Proprietary Compound"; (1 page); Apr. 2004; www.ferro.com.

Ferro; Performance Pigments and Color; "How CoolColors and Eclipse Work"; (3 pages); http://www.ferro.com/Our+Products/Pigments/Products+and+Markets/Knowledge+Base/Ho...

* cited by examiner

*Primary Examiner*—Hoa V Le
(74) *Attorney, Agent, or Firm*—David Glenn Black

(57) ABSTRACT

The invention relates to an image forming media composition including an infrared reflecting pigment. The infrared reflecting pigment may be one that substantially absorbs light in the visible spectrum of about 400-700 nanometers and reflects greater than about 5.0% of light within the wavelength of about 700-2500 nanometers. The infrared reflecting pigment may therefore be combined with pigments such as carbon black in a toner formulation and provide the ability to control toner thickness level within a device such as a toner patch sensor.

10 Claims, 1 Drawing Sheet

IMAGE FORMING MEDIA CONTAINING REFLECTING PIGMENT

FIELD OF THE INVENTION

The present invention relates to image forming media containing reflecting pigment, such as infrared reflecting pigment. The reflecting pigment may be used to monitor and control thickness of a black layer during a printing operation. The image forming media may include toner, ink, etc., and the image forming apparatus may include an electrophotographic device, ink printer, copier, fax, all-in-one device or multi-functional device.

BACKGROUND OF THE INVENTION

Electrostatically printed color images are typically produced by depositing toners of various colors onto a recording media, such as a sheet of paper. A wide palette of printed colors may be generated by printing yellow, cyan, magenta and black toners in various proportions and combinations. Each individual color of the producible palette may require a specific proportion and combination of toners. If the particular proportions of toner for a selected color cannot be repeatedly deposited on the printed media then the printed color will not be consistent and will vary in hue, chroma, and/or lightness from attempt to attempt of printing. The proportion of each toner color to be deposited may be based on the thickness of the toner layer of a given color. Therefore, controlling the printed colors, and ensuring reproducibility of the printed colors, may be achieved by controlling the toner layer thickness to ensure consistent color reproduction.

SUMMARY OF THE INVENTION

In one exemplary embodiment the present invention relates to image forming media comprising an infrared reflecting pigment. The infrared reflecting pigment may be one that substantially absorbs all light in the visible spectrum of about 400-700 nanometers and reflects greater than about 5.0% of light within the wavelength of about 700-2500 nanometers. The infrared reflecting pigment may therefore be combined with pigments such as carbon black in a toner formulation and provide the ability to control toner thickness level with a device such as a toner patch sensor.

In another exemplary embodiment, the present invention relates to a method of detecting image forming media on a surface. The method includes emitting light on the image forming media wherein the media contains infrared reflecting pigment that substantially absorbs all light in the visible spectrum of about 400-700 nanometers and reflects greater than about 5.0% of light within the wavelength of about 700-2500 nanometers. This may then be followed by detection of the reflected light and determining the thickness of the image forming media.

BRIEF DESCRIPTION OF THE DRAWINGS

The detailed description below may be better understood with reference to the accompanying FIGURE which is provided for illustrative purposes and are not to be considered as limiting any aspect of the invention.

DETAILED DESCRIPTION OF THE INVENTION

Figure 1:
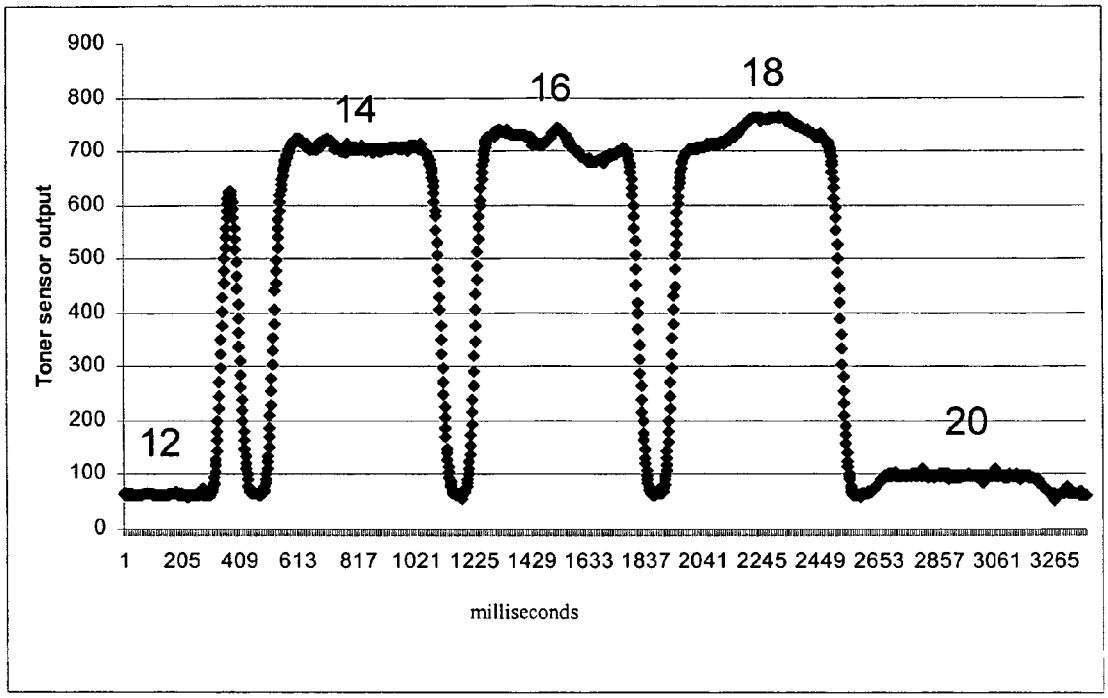
FIG. 1 is a plot showing the infrared reflected signal of various toner formulations including toner containing reflecting pigment.

The present invention generally relates to image forming media containing reflecting pigment, such as infrared reflecting pigment, which may therefore reflect in the wavelength region between about 700-2500 nanometers. The reflecting pigment may be used to monitor and control thickness of the image forming media during printing. The image forming media may include toner, ink, etc., and the image forming apparatus may include an electrophotographic device, ink printer, copier, fax, all-in-one device or multi-functional device. The toner may specifically include toner prepared by chemical processing techniques, or what may be termed chemically processed toner (CPT). The use of one or more reflecting pigments within the image forming media may then facilitate toner layer thickness control. Improved toner layer thickness control may therefore lead to improved ability to accurately and repeatedly produce colors of an image developed on a recording media, e.g. a printed image.

The image forming device herein may include a closed-loop control system to maintain the proportions of image forming media that may be deposited during the image developing process, i.e., during printing. This may eliminate, or at least reduce, color shifts in printed images. In an exemplary control system the toner layer thickness may be determined based on a light signal reflected by a printed test pattern. For example, a light source may be used to illuminate solid and grayscale printed patterns, or patches, of the four toners, i.e., yellow cyan, magenta, and black printed on a control surface. The reflected light signal may then be used to provide toner layer density or thickness. One exemplary device for monitoring toner density or thickness on an unfused image is what may be termed a toner patch sensor as described in U.S. Pat. No. 6,628,398, whose teachings are incorporated by reference. Accordingly, an infrared light signal reflected by a printed toner layer or test pattern may therefore be generally related to the infrared reflectivity of the toner pigment and to the printed density or toner layer thickness.

The image forming media (e.g., toner) to be measured for density or thickness may be placed on a control surface that may include a transport or transfer belt. The toner patches, i.e., the solid and grayscale toner test patterns, may be printed on the control surface and the control surface may be impinged with light from an infrared light source. At least a portion of the infrared light may be reflected by the toner patches and collected by an infrared detector. The toner layer density and/or thickness may be determined from the reflected signal strength of the toner patches, e.g., by comparison to the reflected signal strength from the test surface itself and/or in comparison to the reflected signal strength of a one or more grayscale toner test patterns. The operating conditions of the printer may then be adjusted according to the detected toner layer density and/or thickness in order to provide the necessary proportions of toner to achieve a desired color.

Toner for electrostatic (e.g. laser) printing may be prepared according to a number of techniques. According to a first technique, a so-called "conventional toner" may be prepared from a toner resin that may be melt mixed with pigment and other additives. The melt mixed toner formulation may be crushed, pulverized, milled, etc., to provide fine particles. Additives may be incorporated onto the toner particle surfaces as an extra particulate additive. According to another technique, "chemically produced toner" may be prepared in which toner particles may be prepared by chemical processes such as aggregation or suspension rather than being abraded from much larger size materials by physical processes.

Consistent with the foregoing, a given toner formulation may generally include a resin and a pigment, i.e., a colorant, as well as various additives. The resin itself may generally be relatively transparent to infrared light. In the context of a black toner, the desired black color of the printed toner may be achieved using carbon black as the pigment in the toner formulation. Accordingly it may be understood that reference to black pigment/color herein may be understood as a pigment or combination of pigments which individually or collectively absorb substantially all light throughout the visible spectrum of about 400-700 nanometers. Along such lines, the black pigment or combination of pigments may be such that either alone or in combination they serve to absorb about 90% or more of the visible light thereby minimizing or eliminating the visible light that may reach one's eye, including all values and ranges therein. For example, the black pigment herein may absorb greater than 90%, 91%, etc., or between 95-100% of the visible light. Accordingly, it may therefore be appreciated that black pigmentation may be provided by materials such as oxidic black pigment, including iron oxide black ($Fe_3O_4$) and spinel black ($(Cu(Cr,Fe)_2)O_4$. Black pigmentation may also depend upon the use of organic black colorants (i.e., carbon-based compounds). Furthermore, the black pigments herein may be mixed with pigments of other colors.

It may be therefore appreciated that any particular black pigment, e.g. carbon black, will generally absorb light in the infrared range of the spectrum, which may therefore produce a relatively weak reflected infrared signal. The weak reflected infrared signal may then make it relatively difficult to reliably determine a toner layer thickness of a black toner in a system utilizing infrared reflectivity. According to one aspect of the present invention, image forming media such as a toner formulation for a black toner may include a pigment system including carbon black and an infrared reflecting pigment. For example, the reflecting pigment may include a black infrared reflecting pigment, such as those made available from Ferro Corporation, under the general product designation "ECLIPSE™" or "V-799." Such infrared reflecting pigment may therefore provide the ability to provide a percent reflectance of greater than about 5.0% as compared to a non-reflecting black pigment, which typically absorbs radiation across the entire solar spectrum and reflects less than about 5% within the wavelengths of 700-2500 nanometers. More precisely, the black infrared reflecting pigments herein may provide a reflectance of greater than about 5%, or between about 5-75%, over wavelengths of about 700-2500 nanometers, including all values and ranges therein.

The particular infrared reflecting pigment that may be utilized herein, as dispersed in a black image forming material such as carbon black, may therefore be understood as one which substantially overcomes the relatively strong IR absorption that may typically occur due to black pigment coloration. Therefore, the compound or compounds responsible for infrared reflection herein may be selected such that they will nonetheless provide a detectable infrared reflecting signal that may be suitable for determining black toner density or thickness, or even the amount of toner deposited during printing, within any given pigment formulation. The black infrared reflecting pigment may therefore be one based upon metal oxides, such as $Cr_2O_3$ and $Fe_2O_3$ and may also include infrared black reflecting pigments that are chromium free, and made available under the product designation "ECLIPSE™ 10201" and ECLIPSE™ 10202" from Ferro Corporation, Cleveland, Ohio.

FIG. 1 provides a plot 10 of an infrared reflected signal produced by a control surface 12, and four toner patches 14, 16, 18, 20. The infrared reflected signal produced by the cyan 14, magenta 16, and yellow 18 toner patches are relatively greater than the infrared reflected signal returned by the control surface 12. The black toner formulation producing the depicted infrared reflected signal 20 includes a pigment system including carbon black and a black infrared reflecting pigment. As shown, the infrared reflected signal 20 produced by the black toner formulation using a pigment system including a mixture of carbon black and a black infrared reflecting pigment is clearly distinguishable (i.e. higher) as compared to the infrared reflected signal 12 produced by the control surface. Moreover, it has been found that under certain situations, when one does not utilize black infrared reflecting toner, the toner sensor output for black toner may actually fall well below the reference value for the control surface due to the increased absorption of infrared light due to the presence of carbon black material.

Various ratios of carbon black to black infrared reflecting pigment may be employed to achieve an increase in the infrared reflected signal. The exemplary toner formulation generating the depicted infrared reflected signal 20 in FIG. 1 was developed using a pigment including carbon black and a black infrared reflecting pigment provided at about a 1:1 ratio based on weight. However, in the broad context of the present invention, the infrared reflecting pigment may be present at levels of about 20-70% by weight of the pigment loading in a given image forming media formulation. For example, in a toner formulation which may contain pigment, polymer resin and other additives, the infrared reflecting pigment herein may replace 20-70% by weight of the pigment. Accordingly, if a given toner formulation contains about 95% polymer resin and about 5% pigment, the infrared reflecting pigment, when present at a level of about 50% by weight of the pigment loading, will result in an overall toner formulation containing about 2.5% (wt.) pigment, 2.5% (wt.) infrared reflecting pigment and 95% (wt.) polymer resin material.

In that sense it may be broadly appreciated that one may select an optimum concentration of infrared reflecting pigment, relative to a black toner, so that the toner provides sufficient black imaging characteristics, but at the same time, a detectable infrared reflectance is available so that the thickness of the black toner may be monitored and regulated by a toner patch sensor. That is, the ratio of carbon black to black infrared reflecting pigment may be controlled to provide a sufficient increase in the reflected infrared signal to permit the black toner patch to be distinguished from the control surface while still maintaining a desired jet black characteristic.

The above described black toner formulation may also be provided in combination with a pigment system including a mixture of carbon black and an infrared reflecting pigment having a color other than black. That is, the infrared reflecting pigment may include a relatively dark colored pigment, such as dark blue, dark green, etc. Furthermore, the formulations herein may all be combined with colored pigment systems including cyan, magenta, and yellow (CMY). It may therefore be appreciated that while a cyan, magenta, and/or yellow pigment may provide adequate infrared reflectance to permit toner layer thickness control via use of a toner patch sensor, the incorporation of an infrared reflecting pigment may adjust their particular reflectance response. Therefore, the reflectance response of the cyan, magenta, and yellow pigment may now be controlled and adjusted to be more common with, e.g., a carbon black system mixed with the above-referenced infrared reflecting pigment. This commonality of response between the cyan, magenta, yellow, and carbon black may then provide additional efficiencies in the sensing electronics and the control algorithms of a toner thickness control system. In addition, as a consequence of utilizing a black infrared reflecting toner, it may also become generally unnecessary to operate the toner patch sensor in a relatively high sensitivity mode when measuring black toner thicknesses.

The foregoing description is provided to illustrate and explain the present invention. However, the description hereinabove should not be considered to limit the scope of the invention set forth in the claims appended here to.

What is claimed is:

1. Electrophotographic toner comprising:

a black infrared reflecting pigment;

a black infrared absorbing pigment; and a polymeric resin, wherein loading of said pigments is about 5% by weight of the electrophotographic toner.

2. The electrophotographic toner of claim 1 wherein said black infrared reflecting pigment reflects between about 5-75% of light within the wavelength of about 700-2500 nanometers.

3. The electrophotographic toner of claim 1 wherein said black infrared reflecting pigment absorbs about 90% or more of all light in said visible spectrum.

4. The electrophotographic toner of claim 1 wherein said black infrared reflecting pigment comprises a plurality of black pigments that in combination substantially absorb all light in the visible spectrum wavelength of about 400-700 nanometers.

5. The electrophotographic toner of claim 1 wherein said black infrared absorbing pigment is carbon black.

6. The electrophotographic toner of claim 1 wherein said black infrared reflecting pigment is about 20-70% by weight of said pigment loading.

7. The electrophotographic toner of claim 1 wherein said black infrared reflecting pigment, upon exposure to incident infrared light, is capable of providing a detectable infrared reflection signal response that is capable of identifying a thickness of said image forming media.

8. The electrophotographic toner of claim 1 comprising additional black pigments in combination with said infrared reflecting pigment.

9. The electrophotographic toner of claim 1 located within a printer cartridge.

10. The electrophotographic toner of claim 1 located within an image forming apparatus.

* * * * *

UNITED STATES PATENT AND TRADEMARK OFFICE

CERTIFICATE OF CORRECTION

PATENT NO. : 7,666,562 B2
APPLICATION NO. : 11/362383
DATED : February 23, 2010
INVENTOR(S) : Carter, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 500 days.

Signed and Sealed this

Twenty-eighth Day of December, 2010

David J. Kappos

David J. Kappos
*Director of the United States Patent and Trademark Office*